US005782378A

United States Patent [19]

Hart et al.

[11] Patent Number: 5,782,378

[45] Date of Patent: Jul. 21, 1998

[54] ARTICLE DISPENSER

[75] Inventors: Don Hart; Guy Hart, both of Woodland Hills, Calif.

[73] Assignee: Suncloud Inc., Chatsworth, Calif.

[21] Appl. No.: 684,576

[22] Filed: Jul. 19, 1996

[30] Foreign Application Priority Data

Feb. 18, 1996 [IL] Israel ..... 117163

[51] Int. Cl.[6] ..... G07F 11/00

[52] U.S. Cl. ..... 221/24; 221/199; 221/155; 221/97; 446/170; 446/168

[58] Field of Search ..... 221/24, 155, 97, 221/199; 446/168, 170

[56] References Cited

U.S. PATENT DOCUMENTS

| | | | |
|---|---|---|---|
| 1,700,541 | 1/1929 | Mills | 221/298 |
| 2,729,020 | 1/1956 | Frampton | 446/168 |
| 3,077,254 | 2/1963 | Goldfarb | 221/24 |
| 3,406,971 | 10/1968 | Koff | 446/170 |
| 5,452,822 | 9/1995 | Haymond | 221/155 |

FOREIGN PATENT DOCUMENTS

| | | | |
|---|---|---|---|
| 2335624 | 9/1974 | Germany | 446/168 |

OTHER PUBLICATIONS

'Vending Times', Mar., 199, p. 71 and 5 attached brochures), Mar., 1995.

'Morris Traveler', pp. 104–106, Mar. 1994.

'Play Meter' p. 136, Jul. 1995.

'Deseret News', Sunday, Aug. 20, 1995.

Copy of brchure and photograph of 'Gumball Gizmo', Nov. 1994.

*Primary Examiner*—William E. Terrell
*Assistant Examiner*—Khoi H. Tran
*Attorney, Agent, or Firm*—Oblon, Spivak, McClelland, Maier & Neustadt, P.C.

[57] ABSTRACT

A gumball machine which has a transparent support column supporting a partially transparent gumball housing. The support column encloses several individual plates. The plates are spaced apart and arranged in a descending manner. Each of the plates has an opening located thereon so that a gumball can gravitationally descend from one plate to another and eventually ends up in a dispensing aperture for removal by a customer. The plates can also be manually manipulated by an exterior handle for additional customer amusement.

10 Claims, 3 Drawing Sheets

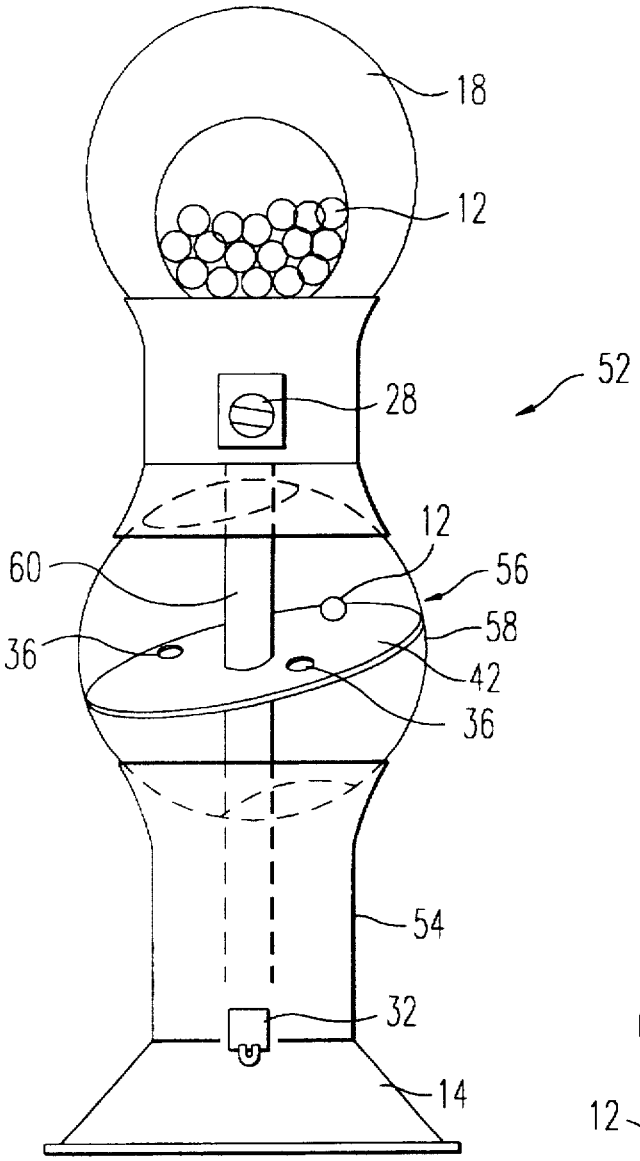
FIG. 3
FIG. 4
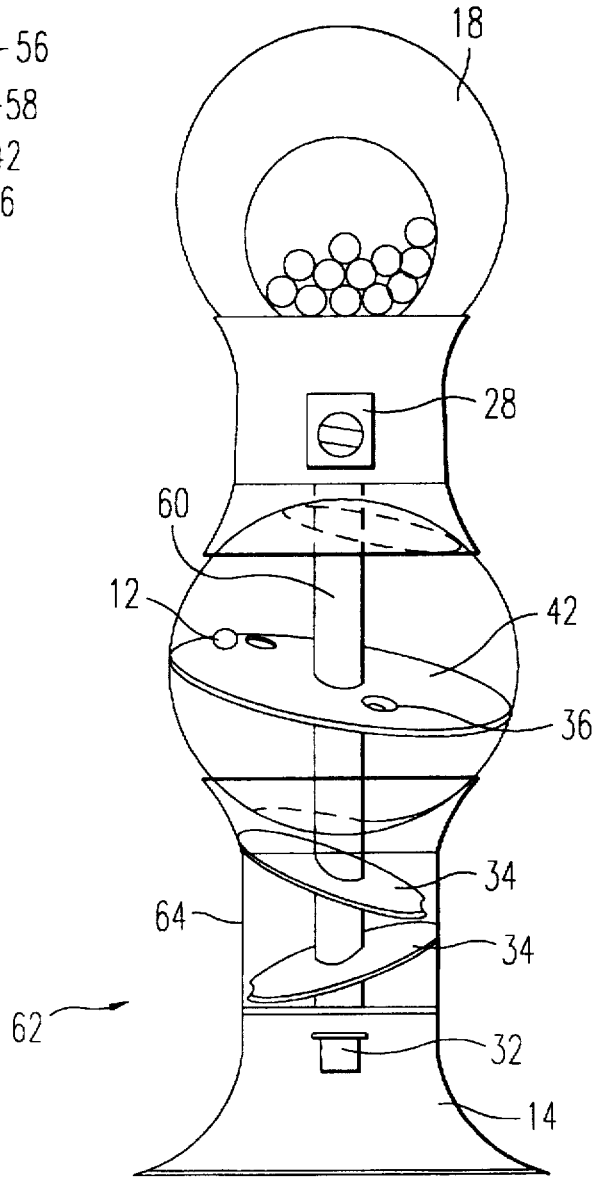

ARTICLE DISPENSER

The present invention relates to a dispenser for gumballs and other small articles, preferably of approximate spherical shape, which are mainly intended for children.

More particularly, the invention provides means for dispensing such articles along an extended irregular path which is visible to the user, the travel of said articles along said path providing entertainment to the user.

It has long been known that consumers can be motivated to purchase an article by offering the prospective purchaser some benefit, even of an intangible type, which has no connection with the satisfaction to be derived from the use or consumption of the purchased article itself. Many examples thereof are given in the book "The Hidden Persuaders," by Vance Packard, published by David McKay in 1957. Whatever one's view of this type of marketing, exhaustive studies have been carried out which verify the effectiveness of such techniques beyond reasonable doubt.

Gumballs, candies and children's trinkets are widely available in grocery stores, kiosks and supermarkets. It has been found that children will pay a somewhat higher price for such articles when an amusement factor is an added attraction to such a purchase. Such is the case when children are themselves invited to insert a token or coin into a dispensing machine, the operation of which gives them a feeling of importance.

Dispensing machines can be located in areas open to the public at all times, whereby sales can be effected even when the business premises of the dispenser's owner or operator are closed.

A known type of dispensing machine for gumballs and other small articles has an extended spiral path connecting the upper storage container with a dispensing door positioned in the pedestal of the machine, slightly above ground level. A coin-operated release mechanism feeds a single item to the top of said spiral path, and the purchaser of the gumball or the like can observe through a transparent wall of the pedestal as the released item travels along the extended path downwards towards the dispensing door. The purchaser, however, has no control over the descent of the purchased item, which follows a simple and predictable downward spiral path.

It is one of the objects of the present invention to provide a dispenser having an irregular exit path for the purchased item. It is a further object of the invention to offer the user a measure of control over said exit path.

The present invention achieves the above objectives by providing a dispenser for small articles, of the type comprising a base; an at least partially transparent, substantially hollow support column supported by said base; and a housing, held above said support column and containing a multiplicity of articles selected from the group consisting of gumballs, candies, children's trinkets, and combinations thereof; at least a segment of an outer wall of said housing being transparent for viewing; said housing being provided with an aperture at a lower segment thereof connected to a token-operated release mechanism for dispensing said articles individually from said container via said column to a dispensing aperture; characterized by the inclusion in said column of a plurality of individual barrier plates, sequentially arranged in spaced-apart descending order between said housing and said base, each of said plates being provided with an opening to enable the gravity-assisted descent of said article from said housing to said dispensing aperture after it travels along a path on an upper surface of each of said sequentially positioned plates.

In a preferred embodiment of the present invention, there is provided a dispenser wherein at least one of said barrier plates is attached to means enabling its manipulation.

In a most preferred embodiment of the invention, there is provided a dispenser wherein the upper surface of at least one of said barrier plates is further provided with obstacles for lengthening the path of travel of a dispensed article moving over said plate.

Still further embodiments of the invention will be described below.

It will thus be realized that the novel dispenser of the present invention serves to enhance motivational buying of the proffered item, by adding interest to its discharge from the dispenser in an unpredictable way and by offering the user some degree of control of the exit path. The use of gravity to drive the dispensed item enables the provision of a low-cost, reliable device. Furthermore, the novel arrangement of the components of the present dispenser results in a slowing of the gravity-assisted descent rate of the dispensed article, thereby prolonging the entertainment value thereof.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 3 is a front elevational view of another embodiment of the invention, having a barrier plate which can be manipulated;

FIG. 4 is a front elevational view of a further embodiment of the invention, provided with both stationary and movable barrier plates;

Figure 1:
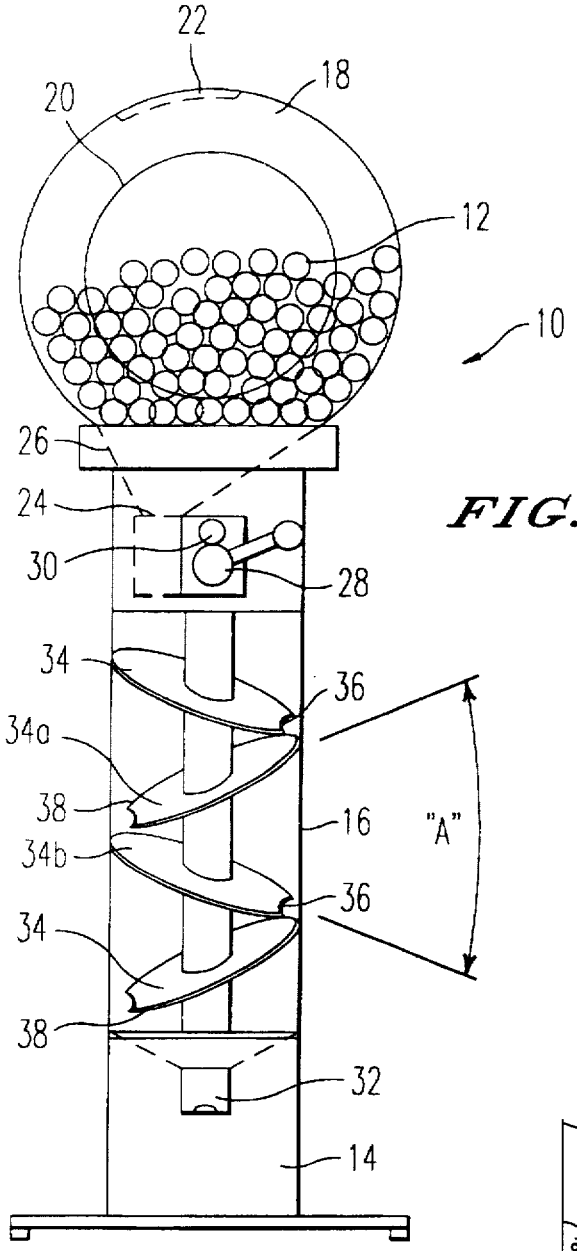
FIG. 1 is a front elevational view of a preferred embodiment of the dispenser according to the invention.

There is seen in FIG. 1 a dispenser 10 for articles 12, such as gumballs, candies and children's trinkets. Any non-sticky article which will slide down the smooth hard surface of a 20-degree declined plane can be dispensed from the embodiments described herein, except the embodiment of FIG. 5. Spherical, or nearly spherical, articles 12 can be dispensed without difficulty by all of the embodiments of the dispenser.

Dispenser 10 includes a base 14, which holds an at least partially transparent, substantially hollow, upwardly projecting support column 16. Housing 18 is held above the column 16, housing 18 containing a multiplicity of articles 12 to be dispensed. Preferably, at least a segment 20 of outer wall 22 of housing 18 is transparent for viewing its contents.

Housing 18 is provided with aperture 24 at a lower segment 26 thereof, aperture 24 being connected to a token-operated release mechanism 28 for individually dispensing articles 12. Advantageously, the token is a coin 30.

The released articles 12 roll, fall or slide via column 16 to a dispensing aperture 32. A plurality of individual barrier plates 34 is sequentially arranged within the column, in spaced-apart decending order, between housing 18 and base 14. The released articles 12 travel along a path on an upper surface of each sequentially-positioned barrier plate 34. Advantageously, each barrier plate 34 is oriented at an angle relative to the horizontal plane. Each barrier plate 34 is provided with an opening 36 near its lowest edge 38 to enable continuation of the gravity-assisted descent of the article 12 from the housing 18 to the dispensing aperture 32. Preferably, at least one pair of sequentially arranged barrier plates 34*a*, 34*b* define between them an imaginary acute angle A, and opening 36, provided in the upper plate 34*a* of the pair, is positioned proximate to the corner of angle A.

With reference to the rest of the figures, similar reference numerals are used for identifying similar parts.

Figure 2:
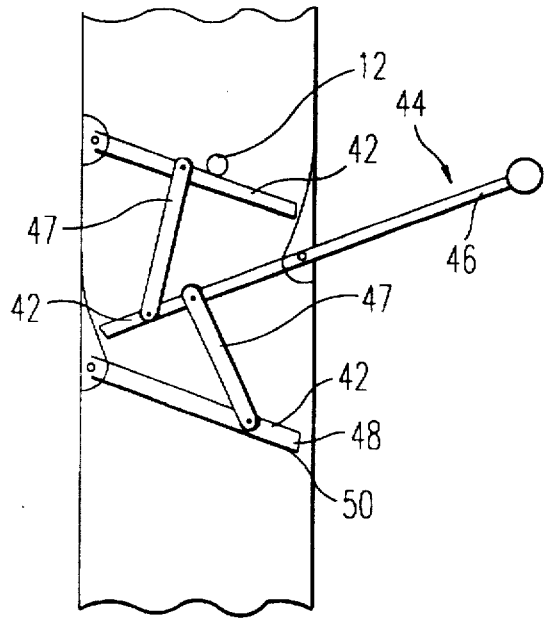
FIG. 2 is a detailed view of part of a dispenser, wherein several barrier plates are attached to means enabling their manipulation.

Referring now to FIG. 2, there is shown a detail of a dispenser embodiment 40, similar to dispenser 10 but wherein several barrier plates 42 are attached to means 44 which enable their manipulation. In the embodiment of FIG. 2, the means 44 comprises a control handle 46 and link members 47. The user can grasp the control handle 46 and thereby alter the orientation of the movable barrier plates 42. For example, it is possible to delay the descent of the dispensed article 12 by raising the edge 48 of barrier plate 42, which is provided with opening 50.

FIG. 3 illustrates a dispenser 52 wherein column 54 includes a movable segment 56, shown as sub-housing 58 attached to the barrier plate 42 to enable its manipulation. The sub-housing 58 can be grasped between the two hands of the user and slanted in any direction so as to change the exit path of the article 12 being dispensed. The structure includes a rigid central post 60 for supporting container 18.

There is shown in FIG. 4 a dispenser 62 wherein the column 64 is provided with both stationary barrier plates 34 and movable barrier plates 42. Thus, the dispenser 62 provides amusement to users who wish to manipulate the movable barrier plates and also entertains users who may be too young to do so.

Figure 5:
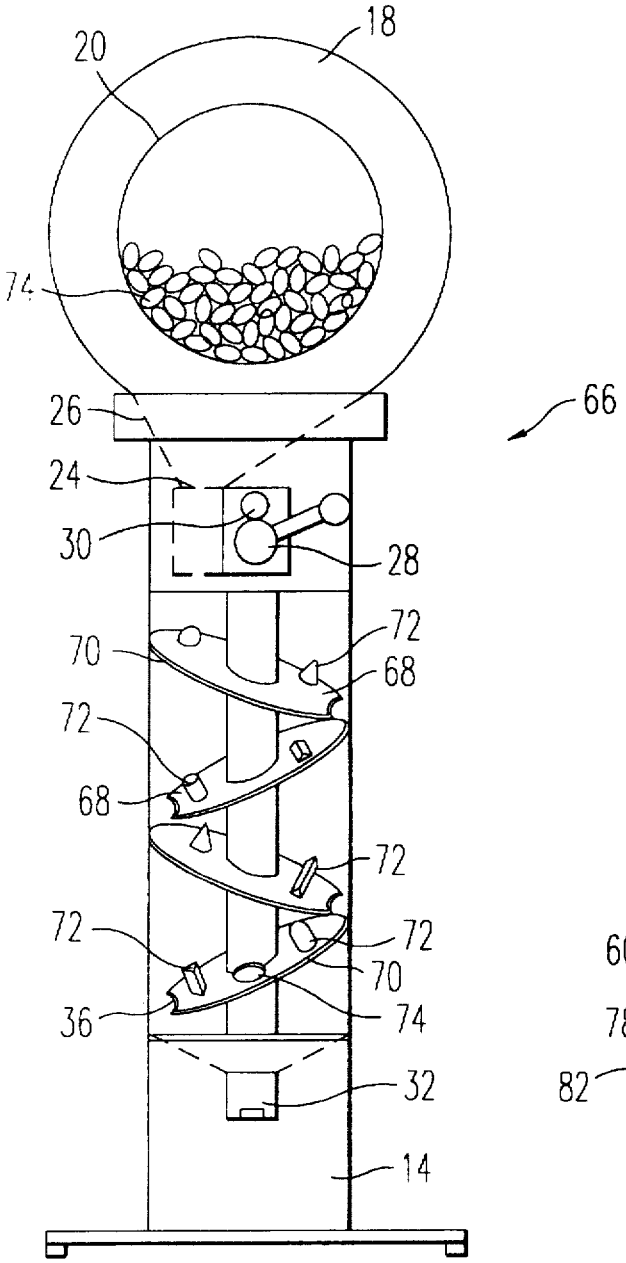
FIG. 5 is a front elevational view of a yet further embodiment of the invention, wherein fixed barrier plates are provided with obstacles for lengthening the path of travel of the dispensed article.

Referring now to FIG. 5, there is depicted a dispenser 66, similar to that described above with reference to FIG. 1, but wherein the upper surface 68 of barrier plates 70 is further provided with obstacles 72 for lengthening the path of travel of a dispensed article 74, shown as an ellipsoid, moving thereover. Dispensed article 74 collides with some of obstacles 72, which results in unpredictable and surprising changes in its exit path, this being viewed with enjoyment by the user.

Figure 6:
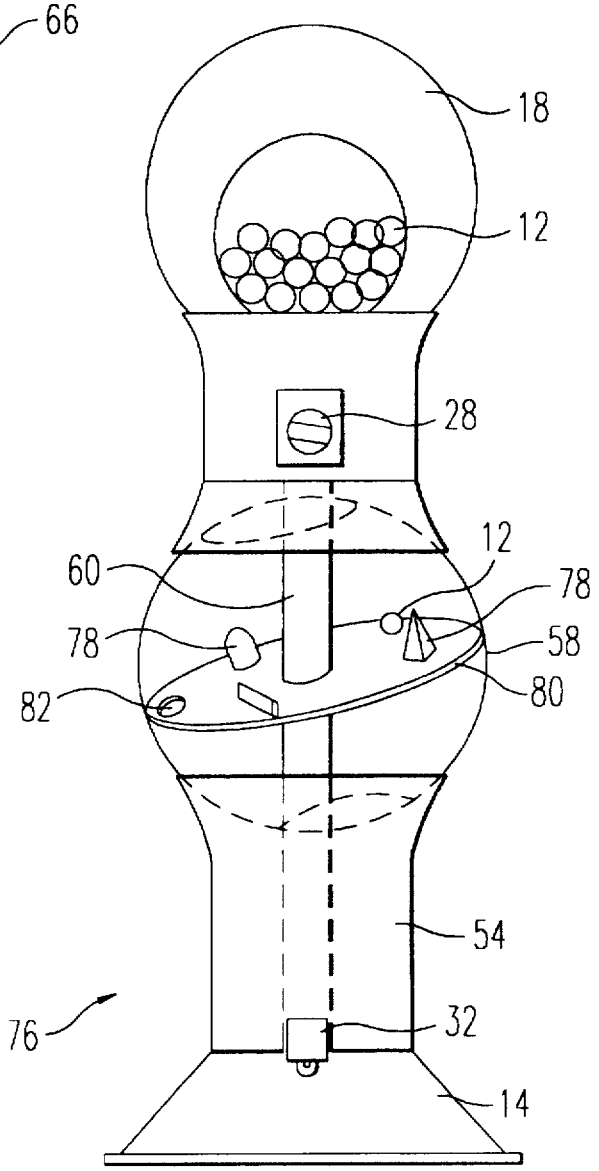
FIG. 6 is a front elevational view of a still further embodiment of the invention, wherein obstacles are provided on a movable barrier plate.

FIG. 6 illustrates a dispenser 76, which is generally similar to that described above with reference to FIG. 3, but wherein obstacles 78 are provided on a movable barrier plate 80. The user can thus arrange the occurrence of collisions between dispensed article 12 and obstacles 78, or he can manipulate the barrier plate 80 to avoid collision. In either case, the dispensed article eventually passes through opening 82 and reaches the dispensing aperture 32.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A dispenser for small articles, of the type comprising:

a base;

an at least partially transparent, substantially hollow support column supported by said base; and a housing, held above said support column and containing a multiplicity of articles selected from the group consisting of gumballs, candies, children's trinkets, and combinations thereof, at least a segment of an outer wall of said housing being transparent for viewing;

said housing being provided with an aperture at a lower segment thereof connected to a token-operated release mechanism for dispensing said articles individually from said container via said column to a dispensing aperture;

characterized by the inclusion in said column of a plurality of individual barrier plates, sequentially arranged in spaced-apart descending order between said housing and said base, each of said plates being provided with an opening to enable the gravity-assisted descent of said article from said housing to said dispensing aperture after it travels along a path on an upper surface of each of said sequentially positioned plates.

2. The dispenser as claimed in claim 1, wherein at least one of said barrier plates is attached to means for enabling its manipulation.

3. The dispenser as claimed in claim 2, wherein said manipulation means comprises a control handle.

4. The dispenser as claimed in claim 2, wherein said column includes a movable segment attached to said barrier plate for enabling its manipulation.

5. The dispenser as claimed in claim 1, wherein each of said plates is oriented at an angle relative to a horizontal plane.

6. The dispenser as claimed in claim 1, wherein at least one pair of said sequentially arranged barrier plates defines an imaginary acute angle between them, and wherein the opening provided in the upper plate of said pair is positioned in proximity to the corner of said acute angle.

7. The dispenser as claimed in claim 1, wherein said token is a coin.

8. The dispenser as claimed in claim 1, wherein said column is provided with both stationary and movable barrier plates.

9. The dispenser as claimed in claim 1, wherein the upper surface of at least one of said barrier plates is further provided with obstacles for lengthening the path of travel of a dispensed article moving over said plate.

10. The dispenser as claimed in claim 9, wherein said obstacles are provided on a movable barrier plate.

* * * * *